US008854293B2

(12) United States Patent
Seong et al.

(10) Patent No.: US 8,854,293 B2
(45) Date of Patent: Oct. 7, 2014

(54) APPARATUS AND METHOD FOR DRIVING LIGHT SOURCE OF BACK LIGHT UNIT

(75) Inventors: Nakjin Seong, Kyungbuk (KR); Wonyong Park, Daegu (KR); Sangsoo Han, Seoul (KR); Namkyun Cho, Kyungbuk (KR); Kyuman Lee, Kyungbuk (KR); Jaeseo Kim, Chungbuk (KR)

(73) Assignee: LG Display Co., Ltd., Seoul (KR)

( * ) Notice: Subject to any disclaimer, the term of this patent is extended or adjusted under 35 U.S.C. 154(b) by 815 days.

(21) Appl. No.: 12/292,695

(22) Filed: Nov. 24, 2008

(65) Prior Publication Data

US 2010/0001944 A1 Jan. 7, 2010

(30) Foreign Application Priority Data

Jul. 4, 2008 (KR) ..... 10-2008-0064969

(51) Int. Cl.

| | |
|---|---|
| ***H05B 37/02*** | (2006.01) |
| ***H05B 33/08*** | (2006.01) |
| ***G09G 3/36*** | (2006.01) |
| *G09G 3/34* | (2006.01) |

(52) U.S. Cl.

CPC ..... *H05B 33/0818* (2013.01); *G09G 2360/16* (2013.01); *G09G 2320/0233* (2013.01); *G09G 2320/064* (2013.01); *G09G 3/3648* (2013.01); *G09G 3/342* (2013.01)

USPC ..... 345/102; 315/192; 315/307

(58) Field of Classification Search

CPC ..... G09G 3/342; G09G 2320/064; G09G 2320/0633; H05B 33/0827

USPC ..... 345/102; 362/97.1; 315/192, 297, 307

See application file for complete search history.

(56) References Cited

U.S. PATENT DOCUMENTS

| | | | | |
|---|---|---|---|---|
| 2006/0232530 | A1 * | 10/2006 | Nagasawa | 345/87 |
| 2007/0262948 | A1 * | 11/2007 | Han et al. | 345/102 |
| 2008/0088571 | A1 | 4/2008 | Lee et al. | |
| 2009/0225020 | A1 * | 9/2009 | Ran et al. | 345/102 |
| 2009/0230891 | A1 * | 9/2009 | Zhao et al. | 315/308 |
| 2009/0261743 | A1 * | 10/2009 | Chen et al. | 315/294 |

FOREIGN PATENT DOCUMENTS

| | | | |
|---|---|---|---|
| JP | 2006-351484 | A | 12/2006 |
| KR | 10-2008-0034316 | A | 4/2008 |
| WO | WO 2008/037641 | A1 | 4/2008 |

OTHER PUBLICATIONS

Japanese Office Action dated Oct. 3, 2011, and its translation.
Korean Office Action (Application No. 10-2008-0064969), dated Oct. 31, 2012.

* cited by examiner

*Primary Examiner* — Allison W Johnson
(74) *Attorney, Agent, or Firm* — Morgan, Lewis & Bockius LLP

(57) ABSTRACT

The exemplary embodiment suggests an apparatus and a method for driving a light source of a backlight unit. The apparatus for driving the light source of the backlight unit comprises a plurality of LED columns; a power output terminal and feedback terminals connected to the LED columns; and an LED driver sequentially driving the LEDs according to sequentially delayed PWM signals. The LED driver decides an operable number of LED channel based on the signals input through the feedback terminals, and sequentially delays the PWM signals with the phase difference controlled by the number of LED channel.

11 Claims, 12 Drawing Sheets

APPARATUS AND METHOD FOR DRIVING LIGHT SOURCE OF BACK LIGHT UNIT

This application claims the benefit of Korea Patent Application No. 10-2008-0064969 filed on Jul. 4, 2008, which is incorporated herein by reference for all purposes as if fully set forth herein.

BACKGROUND OF THE INVENTION

1. Field of the Invention

The exemplary embodiment relates to the backlight unit irradiating lights to the liquid crystal display device. More specially, the exemplary embodiment relates to the apparatus and method for driving light source of the backlight unit.

2. Discussion of the Related Art

Nowadays, due to the characteristics of light weight, slim thickness, low consumption electric power, the liquid crystal display device is widely applied more and more. The liquid crystal display device is applied to the portable computer such as note book PC, the official automation devices, the audio/video devices and the external/internal advertising display devices. The transparent type liquid crystal display device, the mostly used type, shows the picture data by modulating the luminescence of the light incident from the backlight unit by controlling the electric field applied to the liquid crystal layer.

For the light source of backlight unit, the fluorescent lamp such as Cold Cathode Fluorescent Lamp (CCFL) has been used. Recently, however, the light emitting diode (hereinafter "LED") starts to be applied because it has many merits in consumption electric power, weight, luminescence and so on. The backlight unit equipped with a plurality of LED as the light source comprises an LED driver controlling the ON and OFF of the LEDs in response to the pulse width modulation (hereinafter "PWM") signal. The conventional LED driver generally turns ON or OFF all LEDs at the same time in response to one PWM signal. Turning ON or OFF the LEDs at the same time, the amount of light irradiating to the liquid crystal display panel may be fluctuated periodically. As a result, a noise such as wavy noise can be shown in the picture or video screen on the liquid crystal display panel.

SUMMARY OF THE INVENTION

The exemplary embodiment is suggested to solve the drawbacks of the related arts. Thus, the exemplary embodiment is to provide an apparatus and method for driving light source of backlight unit designed to prevent the noise of the image due to fluctuation of the light amount, by maintaining the light amount irradiated into the liquid crystal display panel all the times.

The apparatus for driving light source of the backlight unit according to the exemplary embodiment comprises: a plurality of LED column; and an LED driver including a power output terminal and a plurality of feedback terminal connected to the LED columns, and driving the LEDs sequentially according to the sequentially delayed PWM signals.

The LED driver decides an operable number of LED channel based on the signals input through the feedback terminals, and sequentially delays the PWM signals with a phase difference controlled by the number of LED channel.

The LED driver decides the phase difference with the division value calculated by dividing 360 by the number of LED channel.

The LED driver comprises a feedback voltage detector detecting an electric current of the LED columns input through the feedback terminals, and generating the number of LED channel; a driving voltage generator generating an LED driving voltage supplied to the LED columns, and controlling the LED driving voltage according to the number of LED channel; and a PWM controller delaying the PWM signals with a phase difference in inverse proportion to the number of LED channel.

The method for driving light source of backlight unit according to the exemplary embodiment comprises steps of: connecting a plurality of LED column between a power output terminal of an LED driver and feedback terminals; supplying an LED driving voltage to the LED columns by operating the LED driver, and deciding an operable number of LED channel by the LED driver based on signals input through the feedback terminals; delaying PWM signals with the phase difference sequentially; and sequentially driving the LED columns according to the PWM signals.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Advantages and features of the exemplary embodiment and a method of achieving the advantages and the features will be apparent by referring to embodiments described below in detail in connection with the accompanying drawings.

Referring to the FIGS. 1 to 12, the exemplary embodiment will be explained.

Figure 1:
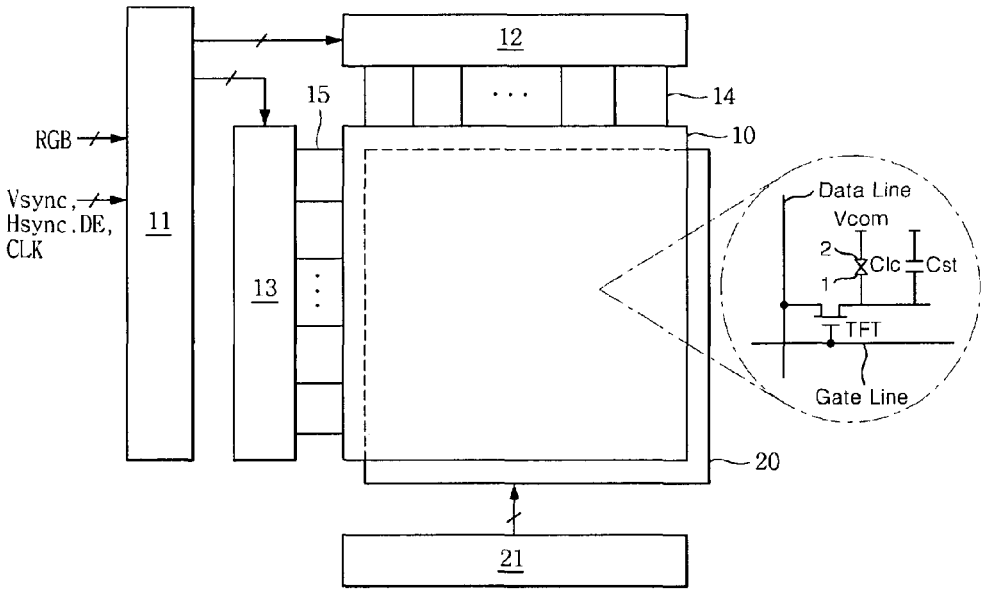
FIG. 1 is the block diagram illustrating a liquid crystal display device according to the exemplary embodiment.

Referring to the FIG. 1, the liquid crystal display device according to the exemplary embodiment comprises a liquid crystal display panel 10, a backlight unit 20 irradiating light to the liquid crystal display panel 10, an LED driver 21 driving LEDs of the backlight unit 20, a source driver 12 driving data lines 14 of the liquid crystal display panel 10, a gate driver 13 driving gate lines 15 of the liquid crystal display panel 10, and a timing controller 11.

The liquid crystal display panel 10 has two glass substrates and a liquid crystal layer there-between. On the lower glass substrate of the liquid crystal display panel 10, a plurality of data lines 14 and a plurality of gate lines 15 are crosswisely disposed. According to the crosswisely disposed structure of the data lines 14 and the gate lines 15, the liquid crystal cells (Clc) are disposed in a matrix array on the liquid crystal display panel 10. Finally, on the lower glass substrate of the liquid crystal display panel 10, data lines 14, gate lines 15, TFTs (Thin Film Transistor), pixel electrode 1 of the liquid crystal cell (Clc) connected to the TFT, and storage capacitor (Cst) are formed.

On the upper glass substrate of the liquid crystal display panel 10, a black matrix, a color filter and a common electrode 2 are formed. The common electrode 2 is formed on the upper glass substrate for the vertical electric field driving type such as TN mode (Twisted Nematic mode) and VA mode (Vertical Alignment mode). On the contrary, for the horizontal electric field driving type such as IPS mode (In-Plane Switching mode) and FFS mode (Fringe Field Switching mode), the common electrode 2 is formed on the lower glass substrate with the pixel electrode 1. On the outer surfaces of the upper and lower glass substrates of the liquid crystal display panel 10, polarization plates are attached. On the inner surface of the upper and lower glass substrate of the liquid crystal display panel 10, alignment layers for pre-tilting angle of the liquid crystal material are formed.

The backlight unit 20 irradiates lights to the liquid crystal display panel 10 from the LEDs turning on and off by the LED driver 21. The backlight unit 20 may be an edge type backlight unit in which the LEDs are disposed at the side surface of the light guide plate. Otherwise, the backlight unit 20 may be a direct backlight type in which the LEDs are disposed under the dispersion plate. The edge type backlight unit 20 receives lights from the LED, changes the incident light to be a uniformed surface light source using the light guide and a plurality of optical sheets stacked on the light guide, and then irradiates the uniformed surface light to the liquid crystal display panel 10. The direct backlight unit 20 makes the lights from the LEDs to be a uniformed surface light source using dispersion plate and a plurality of optical sheets stacked on the dispersion plate, and then irradiates the uniformed surface light to the liquid crystal display panel 10.

The LED driver 21 detects the number of LED channel. It sequentially delays the PWM signals with the phase difference decided by the dividing value controlled by the number of LED channel to optimize the phase differences of the PWM signals according to the number of LED channel actively. The LED driver 21 can control the LED by the local dimming method according to the image analyzing result of the timing controller 11.

The source driver 12 latches the digital video data (RGB) under the control of the timing controller 11. Then, the source driver 12 converts the digital video data (RGB) into the positive/negative analog data voltages using the reference voltage for positive/negative gamma compensation, and then supplies them to the data lines 14.

The gate driver 13 comprises a shift register, a level shifter for changing the output signal of the shift register to the swing width proper to drive the TFT of the liquid crystal cell, and an output buffer. The gate driver 13 sequentially outputs the gate pulse (or scan pulse) having pulse width of 1 horizontal period and supplies to the gate lines 15.

The timing controller 11 receives the digital video data (RGB) and the timing signals (Vsync, Hsync, DE and CLK) from the external video source and supplies the digital video data (RGB) to the source driver 12. Based on the timing signals (Vsync, Hsync, DE and CLK), the timing controller 11 generates the timing control signals for controlling the operating timing of the source driver 12 and the gate driver 13. The timing controller 11 analyzes the input images and controls the LED driver 21 with the local dimming method in order to enlarge the dynamic range of the video image according to the result of the analyzing.

Figure 2:
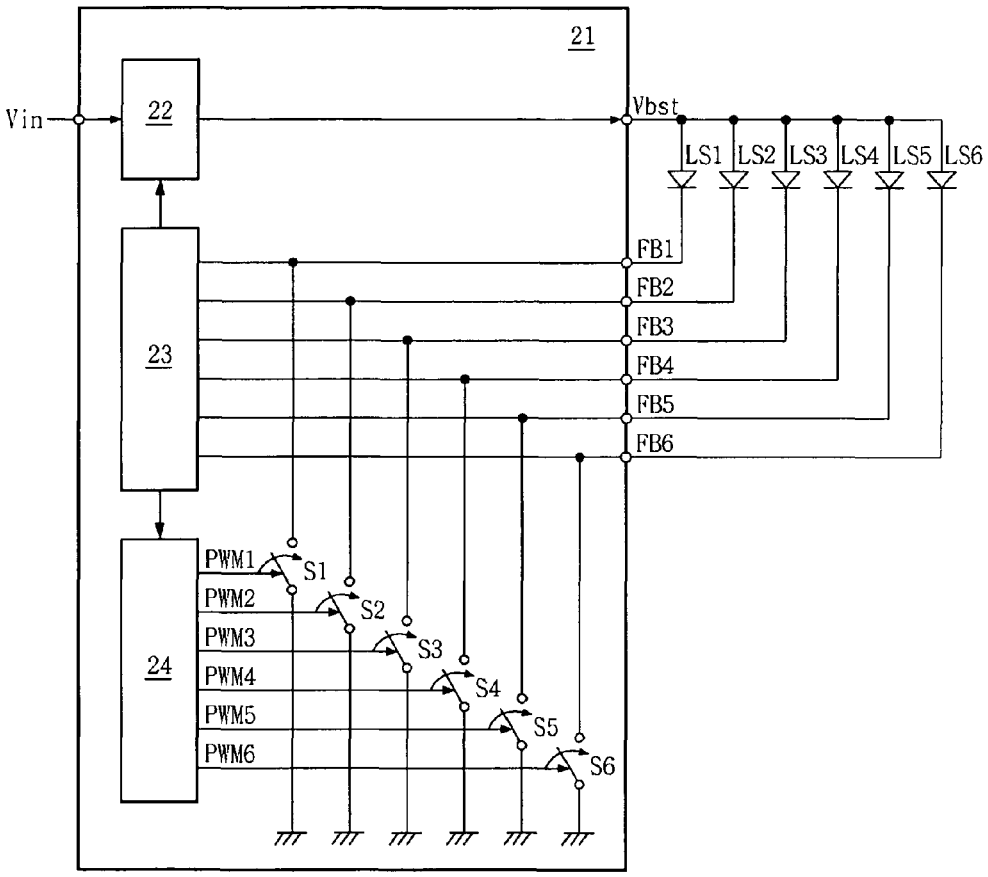
FIG. 2 is the circuit diagram illustrating an LED driver shown in FIG. 1 and 6 LED channels connected to the LED driver.

FIG. 2 is the block diagram illustrating the structure of the LED driver 21.

Referring to FIG. 2, the LED driver 21 comprises a driving voltage generator 22, a feedback voltage detector 23, and a PWM controller 24. The LED driver 21 further comprises a plurality of switch elements (S1 to S6) for switching the current path of the LEDs (LS1 to LS6).

To the power into terminal (Vin) of the LED driver 21, a direct input voltage is supplied. The power output terminal (Vbst) of the LED driver 21 supplies the driving voltage to the anode terminals of a plurality of LEDs (LS1 to LS6). To the feedback terminals (FB1 to FB6) of the LED driver 21, the cathode terminals of the LEDs (LS1 to LS6) are connected, respectively. The number of the feedback terminals (FB1 to FB6) may be 6 as shown in the figure. However, this number can be varied according to the maximum number of the connectable LED channel. Hereinafter, for example, the maximum number of the connectable LED channel to the LED driver 21 is assumed to be 6 so that the number of feedback terminals (FB1 to FB6) is set to be 6.

Figure 3:
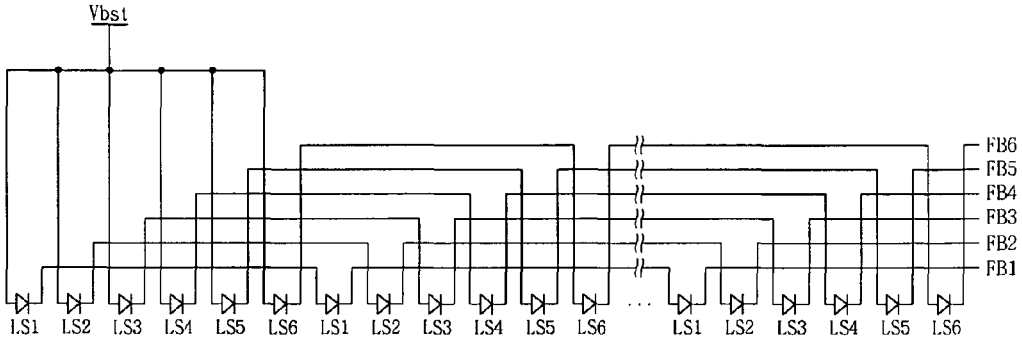
FIG. 3 is the circuit diagram illustrating an LED column.

The anode terminals of the LEDs (LS1 to LS6) are commonly connected to the power output terminal (Vbst) of the LED driver 21. The cathode terminals of the LEDs (LS1 to LS6) are connected to the feedback terminals (FB1 to FB6) of the LED driver 21, respectively. Each of LED (LS1 to LS6) may comprise an LED column including at lease one LED connected in serial as shown in FIG. 3. Hereinafter, we will explain the LED with LED columns. The first LED column (LS1) is connected between the power output terminal (Vbst) of the LED driver 21 and the first feedback terminal (FB1). The second LED column (LS2) is connected between the power output terminal (Vbst) of the LED driver 21 and the second feedback terminal (FB2). The third LED column (LS3) is connected between the power output terminal (Vbst) of the LED driver 21 and the third feedback terminal (FB3). The fourth LED column (LS4) is connected between the power output terminal (Vbst) of the LED driver 21 and the fourth feedback terminal (FB4). The fifth LED column (LS5) is connected between the power output terminal (Vbst) of the LED driver 21 and the fifth feedback terminal (FB5). The sixth LED column (LS6) is connected between the power output terminal (Vbst) of the LED driver 21 and the sixth feedback terminal (FB6).

The driving voltage generator 22 includes a power boost circuit for increasing the input voltage (Vin) to the voltage which can drive the LED columns (LS1 to LS6). The driving voltage generator 22 controls the output voltage, that is the LED driving voltage, according to the number of the LED channel detected by the feedback voltage detector 23. For example, the driving voltage generator 22 increases the output voltage as the number of LED channel is increased. Otherwise, as the number of LED channel is decreased, the driving voltage generator 22 decreases the lowest output voltage.

The feedback voltage detector 23 detects the electric currents of the LED columns (LS1 to LS6) input through the feedback terminals (FB1 to FB6) of the LED driver 21 to decide the number of LED channel connected to the LED driver 21, and supplies the information about the number of LED channel to the driving voltage generator 22 and the PWM controller 24.

The PWM controller 24 generates the first to the sixth PWM signals (PWM1 to PWM6) for turning on or off each of LED column (LS1 to LS6). The PWM signals (PWM1 to PWM6) have phase differences to the other PWM signal having phase difference controlled by the number of LED channel. In addition, the PWM controller 24 delays the PWM signals (PWM1 to PWM6) with the phase differences in inverse proportion to the number of LED channel input from the feedback voltage detector 23.

Being supplied to the control terminal of the first switch element (S1) for switching the electric current path of the first LED column (LS1), the first PWM signal (PWM1) controls the ON/OFF of the first switch element (S1). Being supplied to the control terminal of the second switch element (S2) for switching the electric current path of the second LED column (LS2), the second PWM signal (PWM2) controls the ON/OFF of the second switch element (S2). Being supplied to the control terminal of the third switch element (S3) for switching the electric current path of the third LED column (LS3), the third PWM signal (PWM3) controls the ON/OFF of the third switch element (S3). Being supplied to the control terminal of the fourth switch element (S4) for switching the electric current path of the fourth LED column (LS4), the fourth PWM signal (PWM4) controls the ON/OFF of the fourth switch element (S4). Being supplied to the control terminal of the fifth switch element (S5) for switching the electric current path of the fifth LED column (LS5), the fifth PWM signal (PWM5) controls the ON/OFF of the fifth switch element (S5). Being supplied to the control terminal of the sixth switch element (S6) for switching the electric current path of the sixth LED column (LS6), the sixth PWM signal (PWM6) controls the ON/OFF of the sixth switch element (S6).

One terminal of the first switch element (S1) is connected to a node between the first feedback terminal (FB1) and the first input terminal of the feedback voltage detector 23. The other terminal of the first switch element (S1) is connected to the ground (GND). Responding to the high logic voltage of the first PWM signal (PWM1), the first switch element (S1) turns on to form an electric current path between the first feedback terminal (FB1) and the ground (GND). Responding to the low logic voltage of the first PWM signal (PWM1), the first switch element (S1) turns off to open the electric current path between the first feedback terminal (FB1) and the ground (GND). When the first switch element (S1) turns on, the first LED column (LS1) turns on; while it turns off when the first switch element (S1) turns off. One terminal of the second switch element (S2) is connected to a node between the second feedback terminal (FB2) and the second input terminal of the feedback voltage detector 23. The other terminal of the second switch element (S2) is connected to the ground (GND). Responding to the high logic voltage of the second PWM signal (PWM2), the second switch element (S2) turns on to form an electric current path between the second feedback terminal (FB2) and the ground (GND). Responding to the low logic voltage of the second PWM signal (PWM2), the second switch element (S2) turns off to open the electric current path between the second feedback terminal (FB2) and the ground (GND). When the second switch element (S2) turns on, the second LED column (LS2) turns on; while it turns off when the second switch element (S2) turns off. One terminal of the third switch element (S3) is connected to a node between the third feedback terminal (FB3) and the third input terminal of the feedback voltage detector 23. The other terminal of the third switch element (S3) is connected to the ground (GND). Responding to the high logic voltage of the third PWM signal (PWM3), the third switch element (S3) turns on to form an electric current path between the third feedback terminal (FB3) and the ground (GND). Responding to the low logic voltage of the third PWM signal (PWM3), the third switch element (S3) turns off to open the electric current path between the third feedback terminal (FB3) and the ground (GND). When the third switch element (S3) turns on, the third LED column (LS3) turns on; while it turns off when the third switch element (S3) turns off. One terminal of the fourth switch element (S4) is connected to a node between the fourth feedback terminal (FB4) and the fourth input terminal of the feedback voltage detector 23. The other terminal of the fourth switch element (S4) is connected to the ground (GND). Responding to the high logic voltage of the fourth PWM signal (PWM4), the fourth switch element (S4) turns on to form an electric current path between the fourth feedback terminal (FB4) and the ground (GND). Responding to the low logic voltage of the fourth PWM signal (PWM4), the fourth switch element (S4) turns off to open the electric current path between the fourth feedback terminal (FB4) and the ground (GND). When the fourth switch element (S4) turns on, the fourth LED column (LS4) turns on; while it turns off when the fourth switch element (S4) turns off. One terminal of the fifth switch element (S5) is connected to a node between the fifth feedback terminal (FB5) and the fifth input terminal of the feedback voltage detector 23. The other terminal of the fifth switch element (S5) is connected to the ground (GND). Responding to the high logic voltage of the fifth PWM signal (PWM5), the fifth switch element (S5) turns on to form an electric current path between the fifth feedback terminal (FB5) and the ground (GND). Responding to the low logic voltage of the fifth PWM signal (PWM5), the fifth switch element (S5) turns off to open the electric current path between the fifth feedback terminal (FB5) and the ground (GND). When the fifth switch element (S5) turns on, the fifth LED column (LS5) turns on; while it turns off when the fifth switch element (S5) turns off. One terminal of the sixth switch element (S6) is connected to a node between the sixth feedback terminal (FB6) and the sixth input terminal of the feedback voltage detector 23. The other terminal of the sixth switch element (S6) is connected to the ground (GND). Responding to the high logic voltage of the sixth PWM signal (PWM6), the sixth switch element (S6) turns on to form an electric current path between the sixth feedback terminal (FB6) and the ground (GND). Responding to the low logic voltage of the sixth PWM signal (PWM6), the sixth switch element (S6) turns off to open the electric current path between the sixth feedback terminal (FB6) and the ground (GND). When the sixth switch element (S6) turns on, the sixth LED column (LS6) turns on; while it turns off when the sixth switch element (S6) turns off.

Detecting the number of LED channel, the LED driver 21 automatically controls the phase differences of PWM signals (PWM1 to PWM6) in optimized condition.

Figure 7:
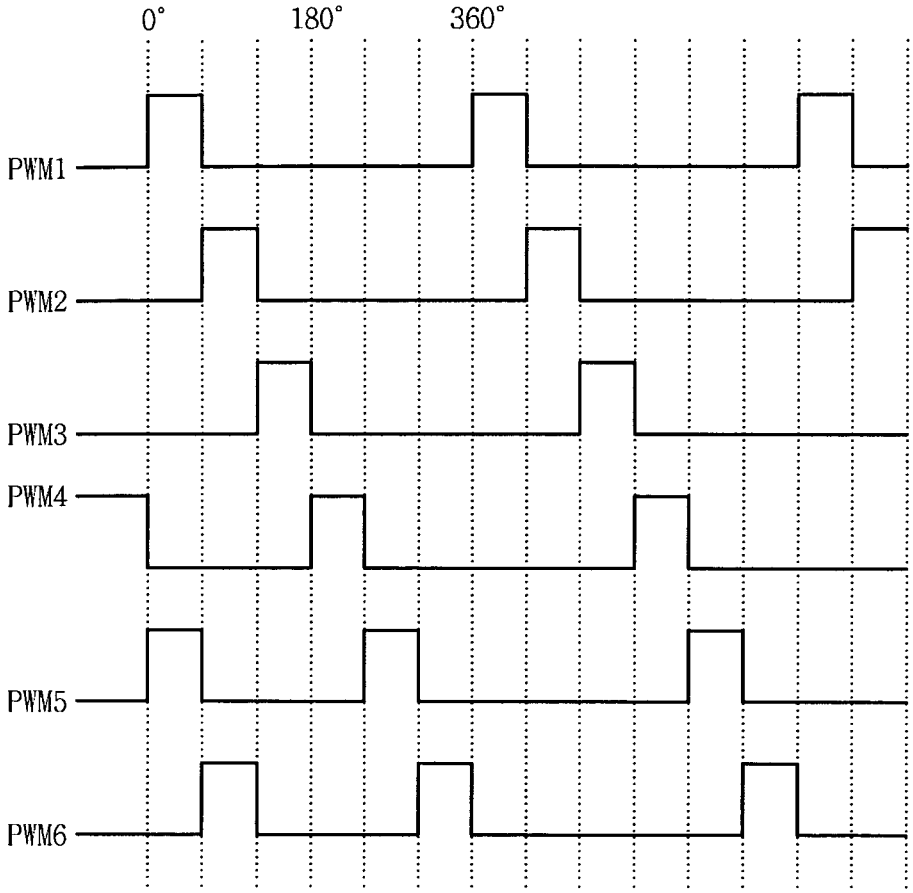
FIG. 7 is the waveform diagram illustrating the phase differences of PWM signals when the LED channels are 6.
Figure 11:
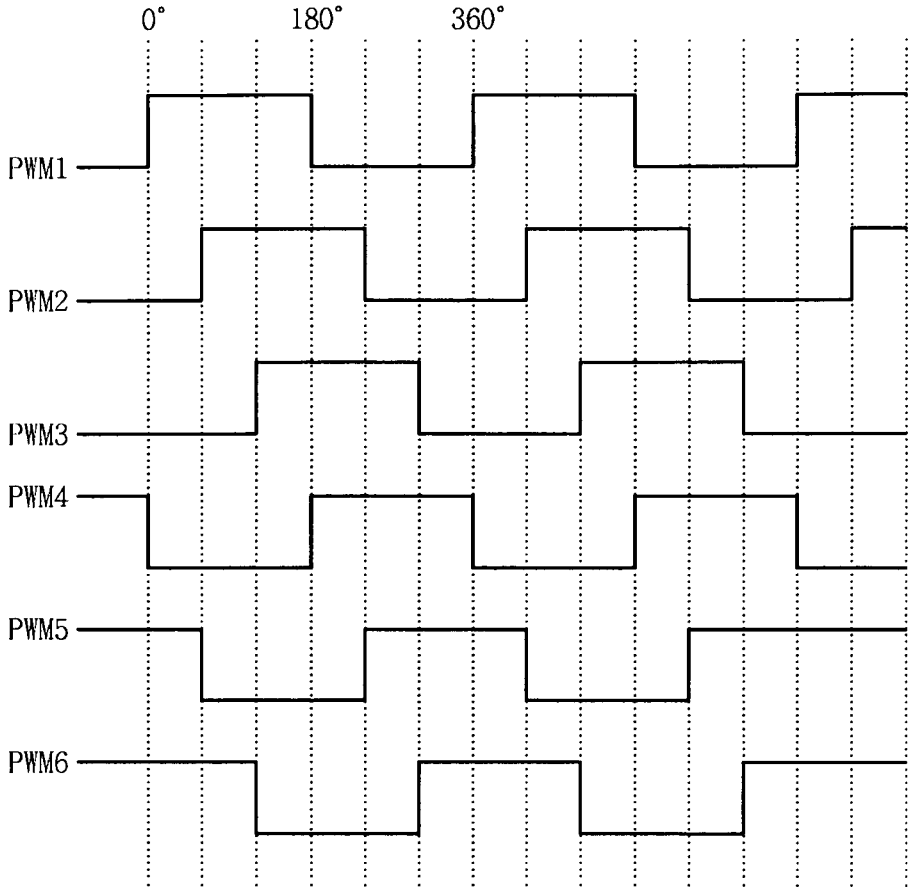
FIG. 11 is the waveform diagram illustrating the phase differences of PWM signals when the LED channels are 6 and the duty ratio of the PWM signals is 50%.

As shown in FIG. 2, when 6 LED columns (LS1 to LS6) are connected to the LED driver 21, the feedback voltage detector 23 detects the electric current amount input through the first to the sixth feedback terminals (FB1 to FB6) so that it decides the number of LED channel of the LED driver 21 as '6' and sends the information of channel number to the driving voltage generator 22 and the PWM controller 24. Then, the driving voltage generator 22 generates the output voltage by boosting the input voltage with voltage proper to drive the 6 LED columns (LS1 to LS6). As shown in FIG. 7, the PWM controller 24 delays the PWM signals (PWM1 to PWM6) with the phase difference of 360/(LED channel number) =360/6=60°, sequentially. The PWM signals (PWM1 to PWM6) sequentially delayed with 60° phase difference, shown in FIG. 7, turn on the LED columns (LS1 to LS6) sequentially so that two LED columns are turn on at every time to keep the light amount irradiated from the backlight unit to the liquid crystal display panel 10 in a uniform level. As a uniform amount of light can be irradiated to the liquid crystal display panel 10 by the LED columns (LS1 to LS6) emitted by the PWM signals (PWM1 to PWM6), the noise due to fluctuated light amount such as wavy noise is not occurred in the image on the liquid crystal display panel 10. If the LED channel number is '6', the PWM controller 24 controls the duty ratio of PWM signals (PWM1 to PWM6) with about 17% to prevent the PWM signals (PWM1 to PWM6) from being overlapped, as shown in FIG. 7. In the interim, the PWM controller 24 can increase the duty ratio of PWM signals (PWM1 to PWM6) up to about 50% so that the PWM signals (PWM1 to PWM6) are overlapped to increase the luminescence of the light irradiated to the liquid crystal display panel 10, as shown in FIG. 11. For the case in which the PWM signals (PWM1 to PWM6) are overlapped due to the increasing of the duty ratio of PWM signals (PWM1 to PWM6), the PWM controller 24 controls the duty ratio of the PWM signals (PWM1 to PWM6) so as to keep the light amount irradiated to the liquid crystal display panel 10 in the same level constantly.

Figure 4:
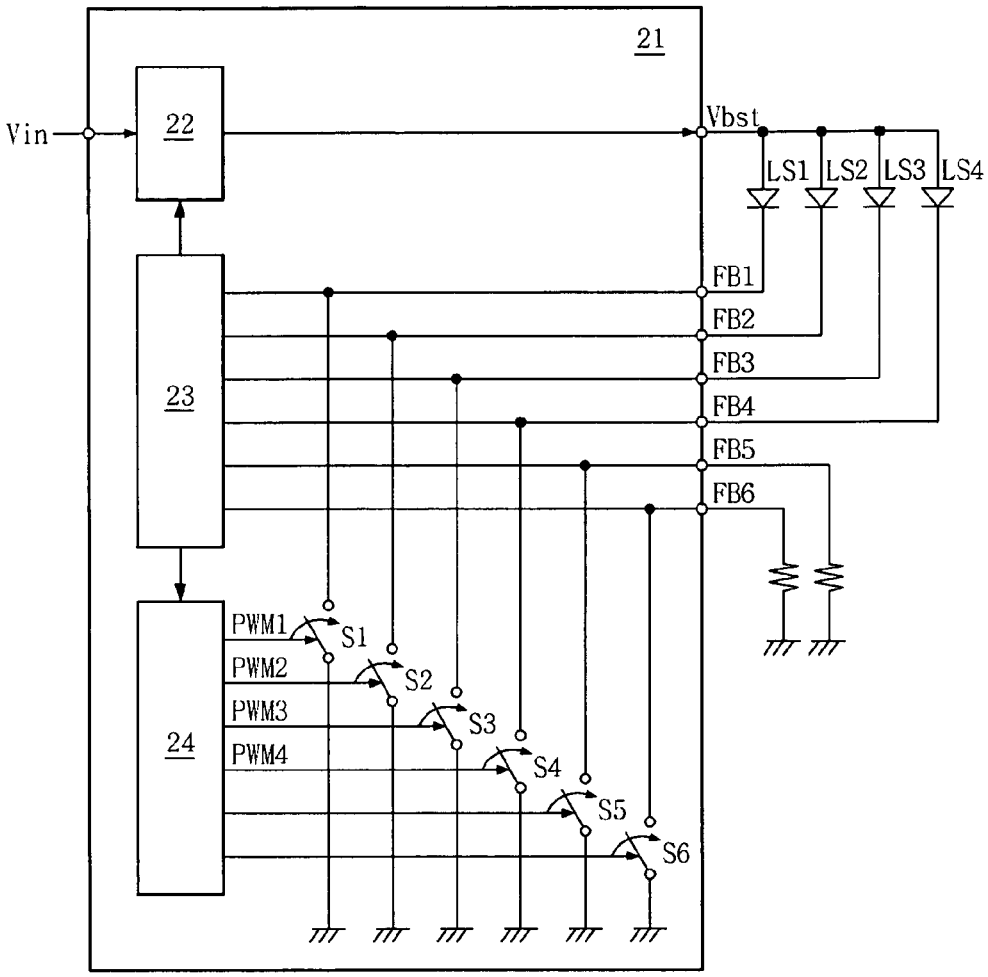
FIG. 4 is the circuit diagram illustrating the LED driver shown in FIG. 1 and 4 LED channels connected to the LED driver.
Figure 8:
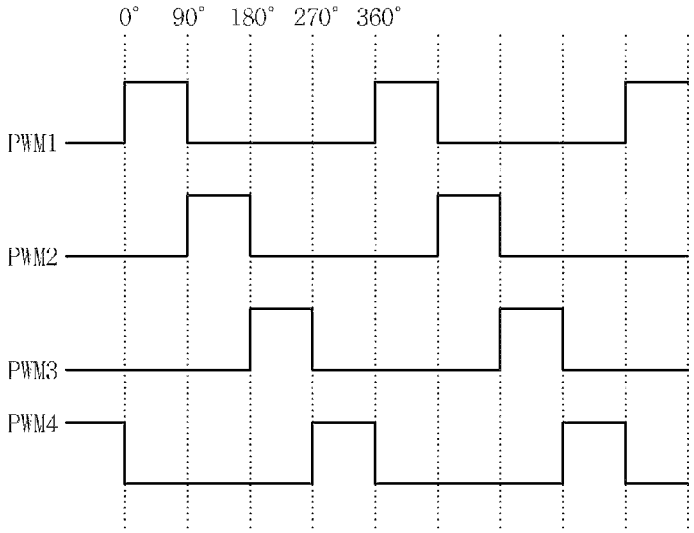
FIG. 8 is the waveform diagram illustrating the phase differences of PWM signals when the LED channels are 4.

FIG. 4 illustrates the condition in which 4 LED columns (LS1 to LS4) are connected to the LED driver 21. As the maximum number of the LED channel of the LED driver 21 is 6, the two feedback terminals (FB5 and FB6) not connected to the LED columns (LS1 to LS4) are connected to the ground (GND) through the pull down resistors. When 4 LED columns (LS1 to LS4) are connected to the LED driver 21, the feedback voltage detector 23 detects the current amount input through the first to the fourth feedback terminals (FB1 to FB4) so that it decides the number of LED channel as '4' and sends the information of channel number to the driving voltage generator 22 and the PWM controller 24. Then, the driving voltage generator 22 generates the output voltage by boosting the input voltage with the voltage proper to drive 4 LED columns (LS1 to LS4). As shown in FIG. 8, the PWM controller 24 sequentially delays the PWM signals (PWM1 to PWM4) with the phase difference of 360/(LED channel number)=360/4=90°. The PWM signals (PWM1 to PWM4) sequentially delayed with 90° phase difference, turn on the LED columns (LS1 to LS4) sequentially so that two LED columns are turn on at every time to keep the light amount irradiated from the backlight unit to the liquid crystal display panel 10 in a uniform level. As a uniform amount of light can be irradiated to the liquid crystal display panel 10 by the LED columns (LS1 to LS4) emitted by the PWM signals (PWM1 to PWM4), the noise due to fluctuated light amount such as wavy noise is not occurred in the image on the liquid crystal display panel 10. When the LED channel number is '4', the PWM controller 24 controls the duty ratio of PWM signals (PWM1 to PWM4) with about 25% to prevent the PWM signals (PWM1 to PWM4) from being overlapped, as shown in FIG. 8. In the interim, the PWM controller 24 can increase the duty ratio of PWM signals (PWM1 to PWM4) up to about 50% so that the PWM signals (PWM1 to PWM4) are overlapped to increase the luminescence of the light irradiated to the liquid crystal display panel 10. For the case in which the PWM signals (PWM1 to PWM4) are overlapped due to the increasing of the duty ratio of PWM signals (PWM1 to PWM4), the PWM controller 24 controls the duty ratio of the PWM signals (PWM1 to PWM4) so as to keep the light amount irradiated to the liquid crystal display panel 10 in the same level constantly.

In the interim, when the LED channel number of the LED driver 21 is '5', the PWM controller 24 sequentially delays the PWM signals (PWM1 to PWM4) with the phase difference of 360/5=72°.

Figure 5:
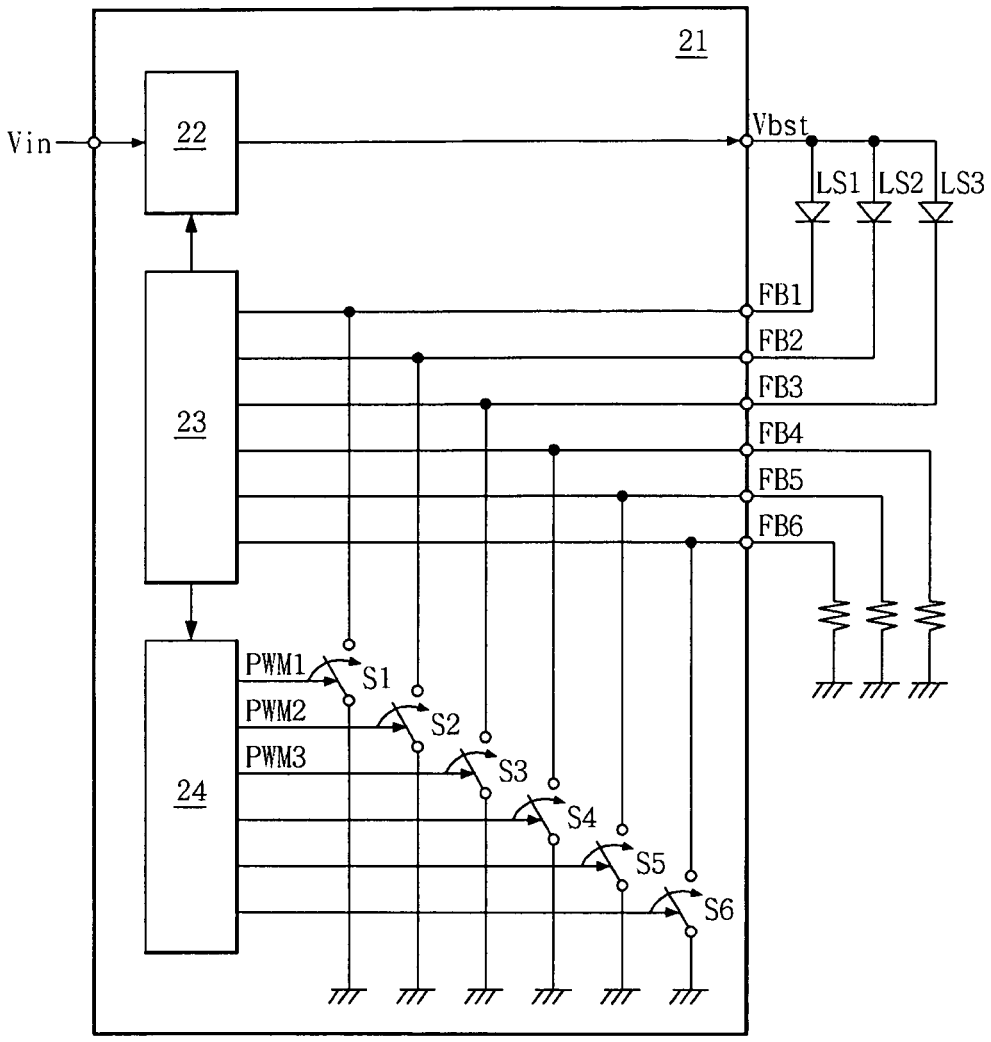
FIG. 5 is the circuit diagram illustrating the LED driver shown in FIG. 1 and 3 LED channels connected to the LED driver.
Figure 9:
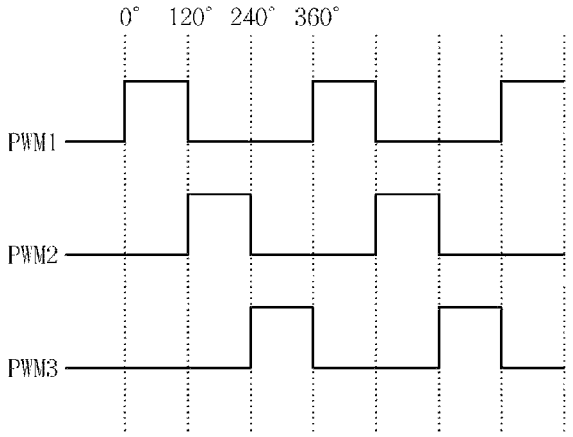
FIG. 9 is the waveform diagram illustrating the phase differences of PWM signals when the LED channels are 3.

FIG. 5 is the circuit diagram illustrating that the 3 LED columns (LS1 to LS3) to the LED driver 21. As the maximum number of the LED channel of the LED driver 21 is 6, the three feedback terminals (FB4 to FB6) not connected to the LED columns (LS1 to LS3) are connected to the ground (GND) through the pull down resistors. When 3 LED columns (LS1 to LS3) are connected to the LED driver 21, the feedback voltage detector 23 detects the current amount input through the first to the third feedback terminals (FB1 to FB3) so that it decides the number of LED channel as '3' and sends the information of channel number to the driving voltage generator 22 and the PWM controller 24. Then, the driving voltage generator 22 generates the output voltage by boosting the input voltage with the voltage proper to drive 3 LED columns (LS1 to LS3). As shown in FIG. 9, the PWM controller 24 sequentially delays the PWM signals (PWM1 to PWM3) with the phase difference of 360/(LED channel number)=360/3=120°. The PWM signals (PWM1 to PWM3) sequentially delayed with 120° phase difference, turn on the LED columns (LS1 to LS3) sequentially so that two LED columns are turn on at every time to keep the light amount irradiated from the backlight unit to the liquid crystal display panel 10 in a uniform level. As a uniform amount of light can be irradiated to the liquid crystal display panel 10 by the LED columns (LS1 to LS3) emitted by the PWM signals (PWM1 to PWM3), the noise due to fluctuated light amount such as wavy noise is not occurred in the image on the liquid crystal display panel 10. When the LED channel number is '3', the PWM controller 24 controls the duty ratio of PWM signals (PWM1 to PWM3) with about 33% to prevent the PWM signals (PWM1 to PWM3) from being overlapped, as shown in FIG. 9. In the interim, the PWM controller 24 can increase the duty ratio of PWM signals (PWM1 to PWM3) up to about 50% so that the PWM signals (PWM1 to PWM3) are overlapped to increase the luminescence of the light irradiated to the liquid crystal display panel 10. For the case in which the PWM signals (PWM1 to PWM3) are overlapped due to the increasing of the duty ratio of PWM signals (PWM1 to PWM3), the PWM controller 24 controls the duty ratio of the PWM signals (PWM1 to PWM3) so as to keep the light amount irradiated to the liquid crystal display panel 10 in the same level constantly.

Figure 6:
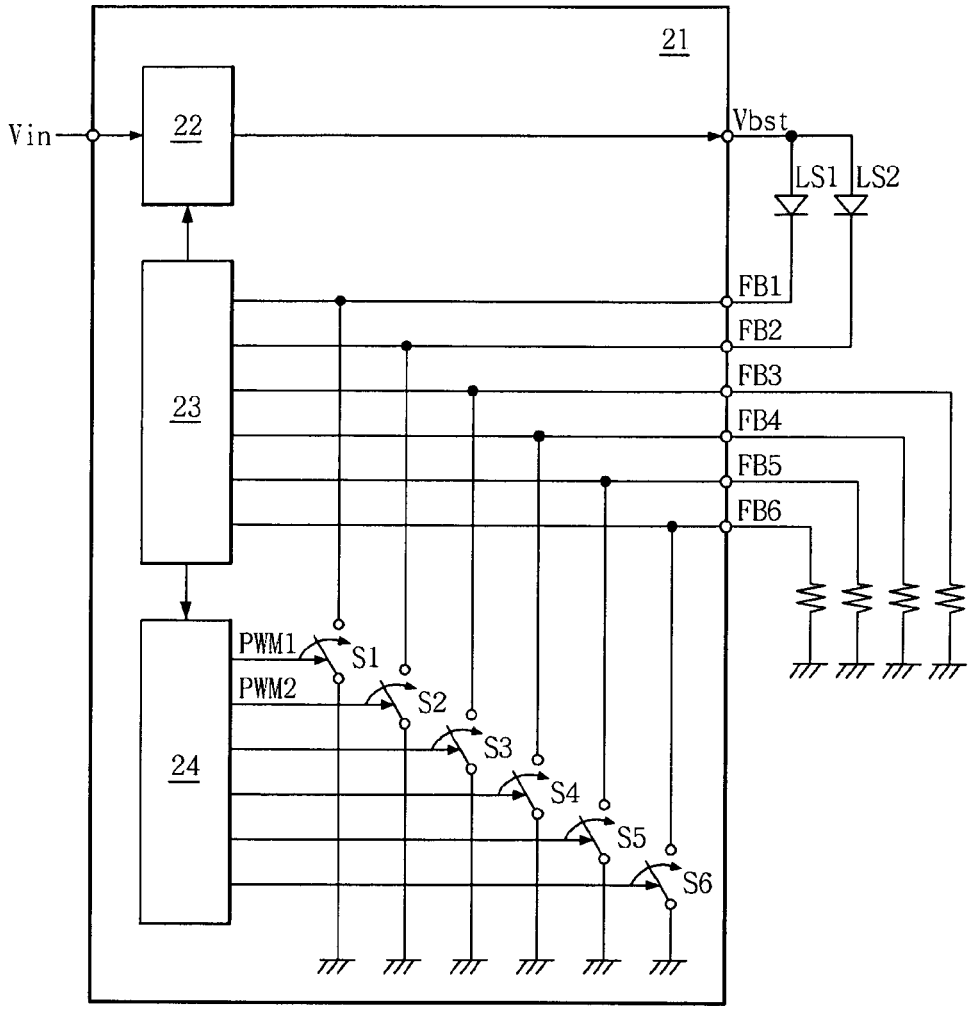
FIG. 6 is the circuit diagram illustrating the LED driver shown in FIG. 1 and 2 LED channels connected to the LED driver.
Figure 10:
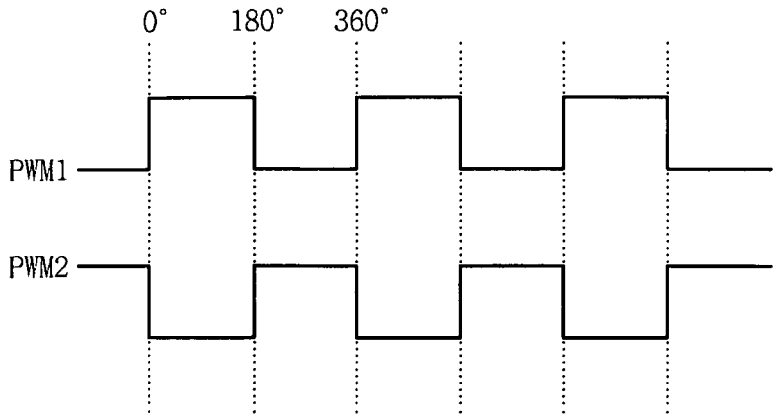
FIG. 10 is the waveform diagram illustrating the phase differences of PWM signals when the LED channels are 2.

FIG. 6 is the circuit diagram illustrating that the 2 LED columns (LS1 and LS2) to the LED driver 21. As the maximum number of the LED channel of the LED driver 21 is 6, the three feedback terminals (FB3 to FB6) not connected to the LED columns (LS1 and LS2) are connected to the ground (GND) through the pull down resistors. When 2 LED columns (LS1 and LS3) are connected to the LED driver 21, the feedback voltage detector 23 detects the current amount input through the first and the second feedback terminals (FB1 and FB2) so that it decides the number of LED channel as '2' and sends the information of channel number to the driving voltage generator 22 and the PWM controller 24. Then, the driving voltage generator 22 generates the output voltage by boosting the input voltage with the voltage proper to drive the 2 LED columns (LS1 and LS2). As shown in FIG. 10, the PWM controller 24 sequentially delays the PWM signals (PWM1 and PWM2) with the phase difference of 360/(LED channel number)=360/2=180°. The PWM signals (PWM1 and PWM2) sequentially delayed with 180° phase difference, turn on the LED columns (LS1 and LS2) sequentially so that two LED columns are turn on at every time to keep the light amount irradiated from the backlight unit to the liquid crystal display panel 10 in a uniform level. As a uniform amount of light can be irradiated to the liquid crystal display panel 10 by the LED columns (LS1 and LS2) emitted by the PWM signals (PWM1 and PWM2), the noise due to fluctuated light amount such as wavy noise is not occurred in the image on the liquid crystal display panel 10. When the LED channel number is '2', the PWM controller 24 controls the duty ratio of PWM signals (PWM1 and PWM2) with 50% to prevent the PWM signals (PWM1 and PWM2) from being overlapped, as shown in FIG. 10.

Figure 12:
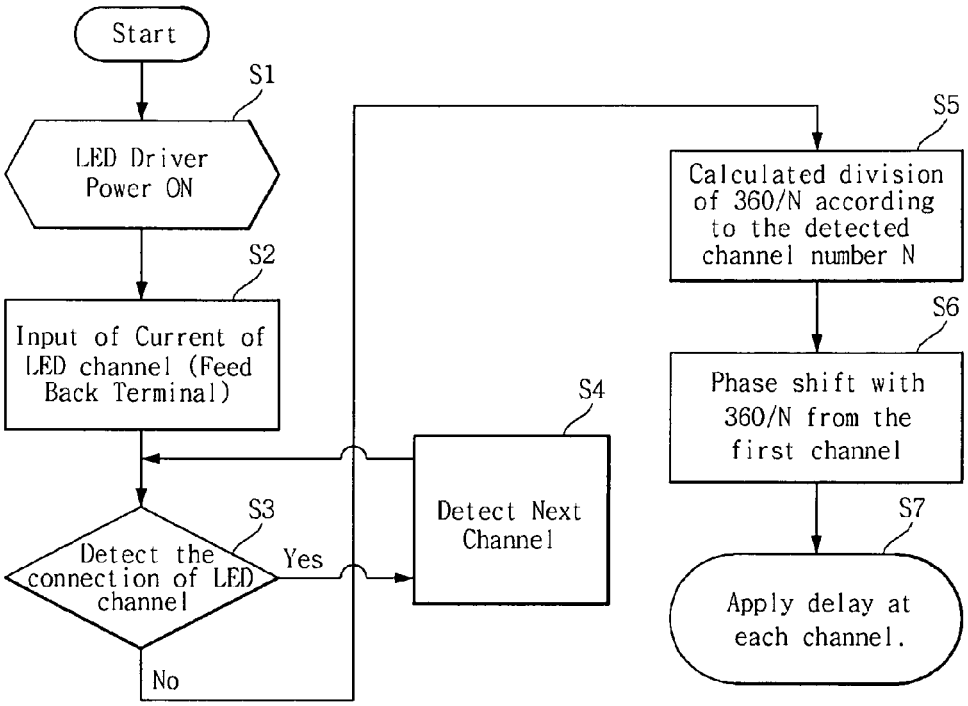
FIG. 12 is a flow chart illustrating, step by step, a controlling sequence of the method for driving the light source of the backlight unit according to the exemplary embodiment.

FIG. 12 is the flow chart illustrating the control sequence of the method for driving the light source of the backlight unit according to the exemplary embodiment.

Referring to FIG. 12, the method for driving the light source of the backlight unit according to the exemplary embodiment is to supply the power to the LED driver 21 to drive the LED driver 21, so that the driving voltage is supplied to the LED columns (LS1 to LS6). The LED driver 21 detects the electric current input through the feedback terminals (FB1 to FB6) to decide the number of LED channel (Steps 122 to 124).

After that, the LED driver 21 calculates the phase difference division value of the PWM signals (PWM1 to PWM6) according to the detected LED channel number. At this time, the PWM controller 21 of the LED driver 21 calculates the division value by dividing 360 by the number of LED channel, as mentioned in above embodiments.

And then, the LED driver 21 sequentially shifts the phase of PWM signals (PWM1 to PWM6) with the phase difference decided by the division value to apply delayed operation to each LED channel (Step 126 and Step 127).

As mentioned above, the apparatus and method for driving the light source of the backlight unit according to the exemplary embodiment detects the LED channel number and actively generates PWM signals delayed with phase difference proper to the number of channel. As a result, the apparatus and method for driving the light source of the backlight unit according to the exemplary embodiment can prevent noise due to fluctuation of light amount from forming on image of display by keeping the light amount irradiating to the liquid crystal display panel in constant.

While the exemplary embodiment has been described in detail with reference to the drawings, it will be understood by those skilled in the art that the invention can be implemented in other specific forms without changing the technical spirit or essential features of the invention. Therefore, the scope of the invention is defined by the appended claims rather than the detailed description of the invention. All changes or modifications or their equivalents made within the meanings and scope of the claims should be construed as falling within the scope of the invention.

What is claimed is:

1. An apparatus for driving a light source of a backlight unit, comprising:

a plurality of LED columns; and an LED driver including a power output terminal and a plurality of feedback terminal connected to the LED columns, the LED driver driving the LEDs sequentially according to the sequentially delayed PWM signals, wherein the LED driver decides an operable number of LED channels based on the signals input through the feedback terminals, and sequentially delays the PWM signals with a phase difference controlled by the number of LED channels, wherein the LED driver comprises:

a power terminal receiving an input voltage to power the LED driver, a feedback voltage detector detecting an electric current of the LED columns input through the feedback terminals, and generating the number of LED channels, a driving voltage generator generating an LED driving voltage supplied to the LED columns, and controlling the LED driving voltage according to the number of LED channels, and a PWM controller delaying the PWM signals with a phase difference in inverse proportion to the number of LED channels, wherein the PWM controller controls the duty ratio of PWM signals to overlap each other to increase the luminescence of the light, wherein the driving voltage generator increases the LED driving voltage as the operable number of LED channels detected by the feedback voltage detector is increased and decreases the LED driving voltage as the operable number of LED channels detected by the feedback voltage detector is decreased, and wherein a feedback terminal not connected to the LED columns is connected to a ground through a resistor.

2. The apparatus according to the claim 1, wherein the LED driver decides the phase difference with the division value calculated by dividing 360 by the number of LED channels.

3. The apparatus according to the claim 1, wherein the LED driver reduces the phase difference as the number of LED channels is increased.

4. The apparatus according to the claim 1, wherein the driving voltage generator controls the LED driving voltage with a voltage in proportion to the number of LED channels.

5. The apparatus according to the claim 1, wherein the driving voltage generator includes a power boost circuit configured to increase the LED driving voltage from the input voltage.

6. A method for driving a light source of a backlight unit, the method comprising:

connecting a plurality of LED columns between a power output terminal of an LED driver and feedback terminals;

supplying an LED driving voltage to the LED columns by operating the LED driver, and deciding an operable number of LED channels by the LED driver based on signals input through the feedback terminals;

controlling a phase difference according to the number of LED channels;

delaying PWM signals with the phase difference sequentially, the PWM signals being partially overlapped to each other to increase the luminescence of the light; and driving the LED columns according to the PWM signals, wherein the LED driving voltage is increased as the operable number of LED channels decided based on the signals input through the feedback terminals is increased and the LED driving voltage is decreased as the operable number of LED channels decided based on the signals input through the feedback terminals is decreased, and wherein a feedback terminal not connected to the LED columns is connected to a ground through a resistor.

7. The method according to the claim 6, further comprising deciding the phase difference with a division value calculated by dividing 360 by the number of LED channels.

8. The method according to the claim 6, wherein the controlling the phase difference reduces the phase difference as the number of LED channels is increased.

9. The method according to the claim 6, further comprising controlling the LED driving voltage according to the number of LED channels.

10. The method according to the claim 9, wherein the controlling the LED driving voltage controls the LED driving voltage with a voltage in proportion to the number of LED channels.

11. The method according to the claim 6, wherein the LED driving voltage is increased from a supply voltage by a power boost circuit.

* * * * *